US011404230B2

(12) United States Patent
Chen et al.

(10) Patent No.: US 11,404,230 B2
(45) Date of Patent: Aug. 2, 2022

(54) FIXING STRUCTURE BETWEEN METAL PART AND PLASTIC PARTS OF RELAY/CIRCUIT BREAKER

(71) Applicant: Xiamen Hongfa Automotive Electronics Co., Ltd., Fujian (CN)

(72) Inventors: Zhenghe Chen, Xiamen (CN); Hongbo Chen, Xiamen (CN); Wenchao Peng, Xiamen (CN)

(73) Assignee: Xiamen Hongfa Automotive Electronics Co., Ltd., Xiamen (CN)

( * ) Notice: Subject to any disclaimer, the term of this patent is extended or adjusted under 35 U.S.C. 154(b) by 252 days.

(21) Appl. No.: 16/464,237

(22) PCT Filed: Nov. 24, 2017

(86) PCT No.: PCT/CN2017/112926
§ 371 (c)(1),
(2) Date: May 24, 2019

(87) PCT Pub. No.: WO2018/095418
PCT Pub. Date: May 31, 2018

(65) Prior Publication Data

US 2019/0272966 A1 Sep. 5, 2019

(30) Foreign Application Priority Data

Nov. 24, 2016 (CN) ..... 201611042826.X

(51) Int. Cl.
*H01H 50/04* (2006.01)
*H01H 71/02* (2006.01)

(52) U.S. Cl.
CPC ..... *H01H 50/041* (2013.01); *H01H 71/0207* (2013.01)

(58) Field of Classification Search
CPC ..... H01H 50/041; H01H 71/0207; H01H 50/023; H01H 49/00; H01H 2050/446;
(Continued)

(56) References Cited

U.S. PATENT DOCUMENTS 4,577,172 A * 3/1986 Schedele ..... H01H 50/043 335/80
9,093,239 B2 * 7/2015 Kato ..... H01H 50/043
(Continued)

FOREIGN PATENT DOCUMENTS

CN 2514481 Y 10/2002
CN 101834049 A 9/2010
(Continued)

OTHER PUBLICATIONS

Chinese Office Action in connection with Chinese Application No. 201611042826.X, dated Feb. 2, 2018.
(Continued)

*Primary Examiner* — Lheiren Mae A Caroc
(74) *Attorney, Agent, or Firm* — Wolf, Greenfield & Sacks, P.C.

(57) ABSTRACT

The disclosure provides fixing structure between a metal part and a plastic part of a relay/circuit breaker, comprising a metal part, a first plastic part and a second plastic part. A positioning groove is disposed on the first plastic part, one portion of the metal part is inserted and positioned in the positioning groove, and the other portion of the metal part is positioned between the first plastic part, and the second plastic part; a through hole is disposed at the second plastic part near to the positioning groove, glue is dispensed into the positioning groove though the through hole. A first glue blocking rib suitably fitting with a corresponding side of the other portion is respectively disposed at a position of the first plastic part corresponding to both sides of the positioning
(Continued)

groove to prevent the glue from following to an inside of the relay/circuit breaker.

10 Claims, 8 Drawing Sheets

(58) Field of Classification Search
CPC ..... H01H 50/443; H01H 50/02; H01H 50/04; H01H 71/02; H01H 71/0214
See application file for complete search history.

(56) References Cited

U.S. PATENT DOCUMENTS

| | | | | |
|---|---|---|---|---|
| 2011/0120844 | A1* | 5/2011 | Hoffmann ..... | H01H 50/02 200/275 |
| 2013/0033352 | A1 | 2/2013 | Wo | |

FOREIGN PATENT DOCUMENTS

| | | | |
|---|---|---|---|
| CN | 202150409 | U | 2/2012 |
| CN | 203288521 | U | 11/2013 |
| CN | 104124107 | A | 10/2014 |
| CN | 106558454 | A | 4/2017 |
| CN | 206236615 | U | 6/2017 |
| DE | 10 2007 025338 | U1 | 12/2008 |
| EP | 0 140 285 | A1 | 5/1985 |
| FR | 2 379 150 | A1 | 8/1978 |
| JP | S57-060355 | U | 4/1982 |
| JP | S59-165640 | U | 11/1984 |
| JP | H10-064399 | A | 3/1998 |

OTHER PUBLICATIONS

Extended European Search Report in connection with European Application No. 17873494.3, dated Apr. 20, 2020.
Japanese communication in connection with Japanese Application No. 2019-528678, dated May 26, 2020.
International Search Report and Written Opinion for International Application No. PCT/CN2017/112926 dated Feb. 23, 2018.
CN 201611042826.X, Feb. 2, 2018, Chinese Office Action.
EP 17873494.3, Apr. 20, 2020, Extended European Search Report.
JP 2019-528678, May 26, 2020, Japanese Communication.
PCT/CN2017/112926, Feb. 23, 2018, International Search Report and Written Opinion.

* cited by examiner

FIXING STRUCTURE BETWEEN METAL PART AND PLASTIC PARTS OF RELAY/CIRCUIT BREAKER

RELATED APPLICATIONS

The present application is a national stage filing under 35 U.S.C. § 371 of international PCT application, PCT/CN2017/112926, filed Nov. 24, 2017, which is based upon and claims priority to Chinese Patent Application No. 201611042826.X, filed on Nov. 24, 2016, the entire contents of each of which are incorporated herein by reference.

TECHNICAL FIELD

The present disclosure relates to a relay/circuit breaker, and more particularly, to a fixing structure between a metal part and a plastic part of a relay/circuit breaker.

BACKGROUND

The relay is an electrical control device, which is an electrical appliance that causes a controlled amount to occur a predetermined step change in an electrical output circuit when the change in an input amount (excitation amount) reaches the specified requirement. It has an interaction between a control system (also known as an input loop) and a controlled system (also known as an output loop). The relay is usually used in automated control circuits. It is actually an "automatic switch" that uses a small current to control the operation of a large current, so it plays a role of automatic regulation, safety protection and conversion circuit in a circuit. A circuit breaker is a switching apparatus that can close, carry and break current under normal loop conditions and can close current, carry and break current under abnormal loop conditions within a specified time. In many relays circuit breakers, it is usually related to fix a metal part such as stationary spring and positioning component to a plastic part such as a bobbin or a bottom base. In the related art, the fixing of the stationary spring and the positioning component are generally performed by disposing a convex bract on the stationary spring and the positioning component respectively, and the convex bracts of the stationary spring and the positioning component are engaged into a slot of the plastic part. This structure is prone to generate particles during the choking setting process, and contaminating the internal environment of the product and causing a decline in product quality. In addition, after the structure is engaged, there is a drawback that the positioning dimension is unstable for easily releasing after being subjected to force. For products such as high-current PCB relays, because of adopting the manner of inverted installation (that is, the bobbin part at the top, the contact part at the bottom) and direct inserting the stationary spring, the positioning component structure is needed to be placed in the middle of the movable spring component. Higher requirements are proposed to the fixing accuracy and stability of the positioning component. However, the fixing structure of the convex bract and the slot in the related art cannot achieve the requirements.

SUMMARY

The purpose of the embodiments of the present disclosure is to overcome the deficiencies of the related art. A fixing structure between a metal part and a plastic part of a relay/circuit breaker is provided. It can be easily disposed and stably fixed without increasing the difficulty of manufacturing parts. It will not easily produce particles to pollute the internal environment of the product. Moreover, the metal part is not easily released after being fixed, and the dimensional stability is strong.

The technical solution adopted by the embodiment of the present disclosure to solve the technical problem existed in the related art is: a fixing structure between a metal part and a plastic part of a relay/circuit breaker, comprising the metal part, a first plastic part and a second plastic part; wherein a positioning groove is disposed on the first plastic part, one portion of the metal part is inserted and positioned in the positioning groove of the first plastic part, and the other portion of the metal part is positioned between the first plastic part and the second plastic part; a through hole is disposed at a position of the second plastic part near to the positioning groove, a glue is dispensed into the positioning groove through the through hole to package the first plastic part, the metal part and the second plastic part together; a first glue blocking rib suitably fitting with a corresponding side of the other portion of the metal part is respectively disposed at a position of the first plastic part corresponding to both sides of the positioning groove to prevent the glue entering through the through hole from flowing to an inside of the relay/circuit breaker.

The metal part is in an L-shape.

One second glue blocking rim suitably fitting with the corresponding side of the other portion of the metal part is respectively disposed at the position corresponding to the both sides of the positioning groove in one side of the second plastic part facing the metal part.

The second glue blocking rib is interposed with the first glue blocking rib to simultaneously block in a path in which the glue flowing to the inside of the relay/circuit breaker.

The first glue blocking rib and the second glue blocking rib are disposed side by side with respect to the corresponding side of the other portion of the metal part to completely overlap and block in the path in which the glue flows to the inside of the relay/circuit breaker.

The first glue blocking rib and the second glue blocking rib are not completely aligned with respect to the corresponding side of the other portion of the metal part to partly overlap and block in the path in which the glue flows to the inside of the relay/circuit breaker.

One side of the second plastic part facing the metal part is further provided with a lug boss for positioning the metal part, the lug boss is against the metal part to position the metal part in a direction convex with respect to the lug boss.

An outer side of the one portion of the metal part is provided with a positioning convex bract, when the one portion of the metal part is inserted into the positioning groove of the first plastic part, an inner side of the one portion of the metal part is attached to a groove wall of the positioning groove for positioning through the convex bract.

An inner side of the other portion of the metal part is provided with a limiting convex bract.

Compared with the prior art, the beneficial effects of the embodiments of the present disclosure are:

1. The positioning groove disposed in the first plastic part is adopted in the embodiment of the present disclosure. The one side of the metal part is suitably mated into the positioning groove. The other side of the metal part is positioned between the first plastic part and the second plastic part. And the through hole is disposed at the position of the second plastic part near the positioning groove. The glue is dispensed into the positioning groove through the through hole to fix the first plastic part, the metal part and the second plastic part together. In the fixing manner of the metal part of the embodiment of the present disclosure, the prior art method of the choking setting manner of the convex bract is not adopted. Therefore, no debris is generated during the assembly process of the product, and the internal environment of the product is not contaminated. At the same time, in this fixing manner, the metal part is not easily released after being fixed, and the dimensional stability is strong. Further, since one first glue blocking rib suitably mating the side of the other side of the metal part is respectively disposed on the position of the first plastic part corresponding to both sides of the positioning groove, the first glue blocking rib can be used to prevent the glue entering through the through hole from flowing to the inside of the relay/circuit breaker.

2. One second glue blocking rim suitably mating the side of the other side of the metal part is adopted by the embodiment of the present disclosure, the second glue blocking rim is respectively disposed at the position corresponding to the both sides of the positioning groove in one side of the second plastic part facing the metal part. Using the intersection of the first glue blocking rib with the second glue blocking rib, both the fixing stability of the metal part can be increased and the glue entering through the through hole can be further prevented from flowing into the inside of the relay/circuit breaker.

3. One lug boss for positioning the metal part in the side of the second plastic part facing the metal part is adopted in the embodiment of the present disclosure, and the lug boss is used to further firmly positioned the metal part.

The embodiments of the present disclosure are further described in detail below in conjunction with the accompanying drawings and the embodiments. However, the fixing structure between the metal part and the plastic part of the relay/circuit breaker of the embodiment of the disclosure is not limited to the embodiment.

DETAILED DESCRIPTION

Embodiment

Figure 1:
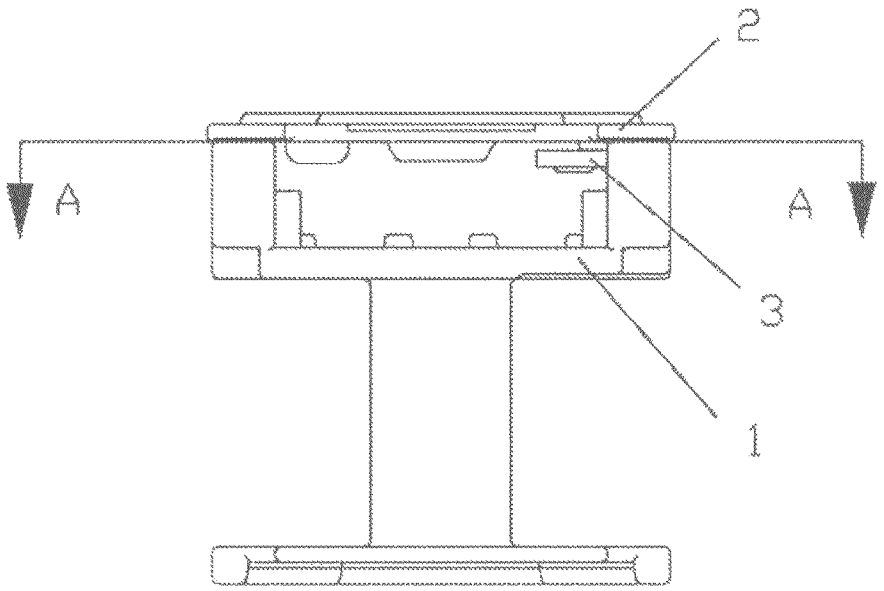
FIG. 1 is a front view of an embodiment of the present disclosure.
Figure 2:
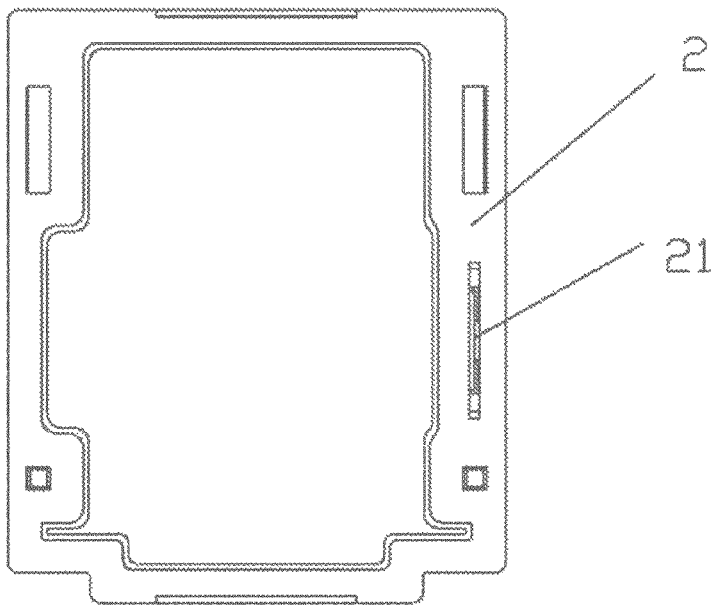
FIG. 2 is a top view of an embodiment of the present disclosure.
Figure 3:
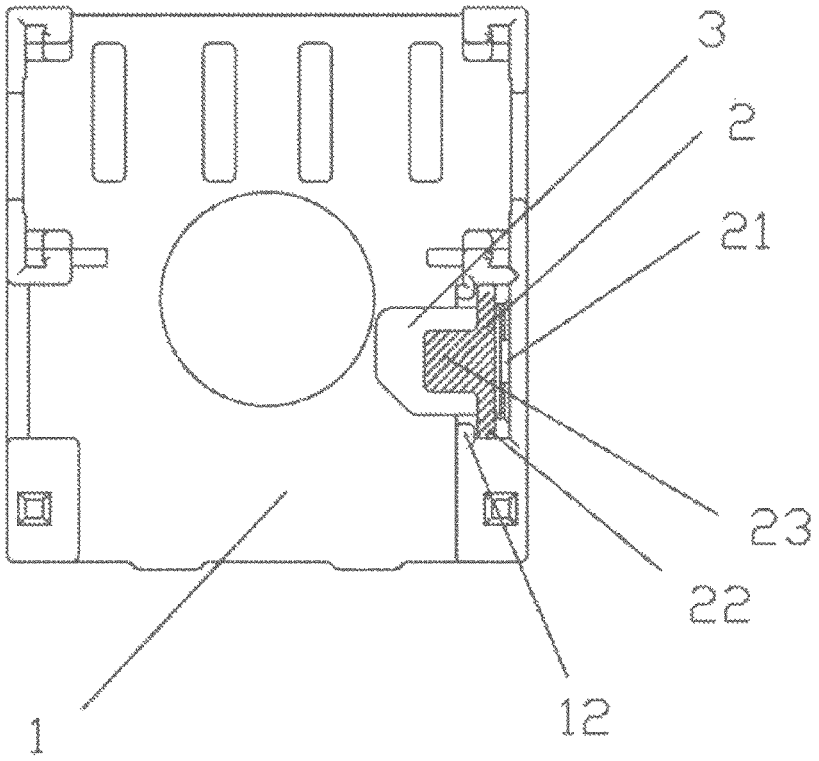
FIG. 3 is a cross-sectional view taken along a line A-A in FIG. 1.
Figure 4:
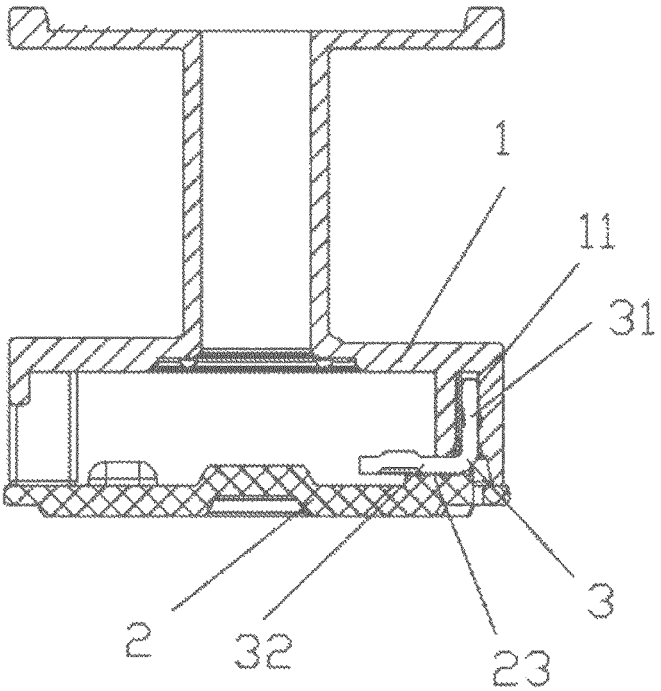
FIG. 4 is a cross-sectional view of an embodiment of the present disclosure.
Figure 5:
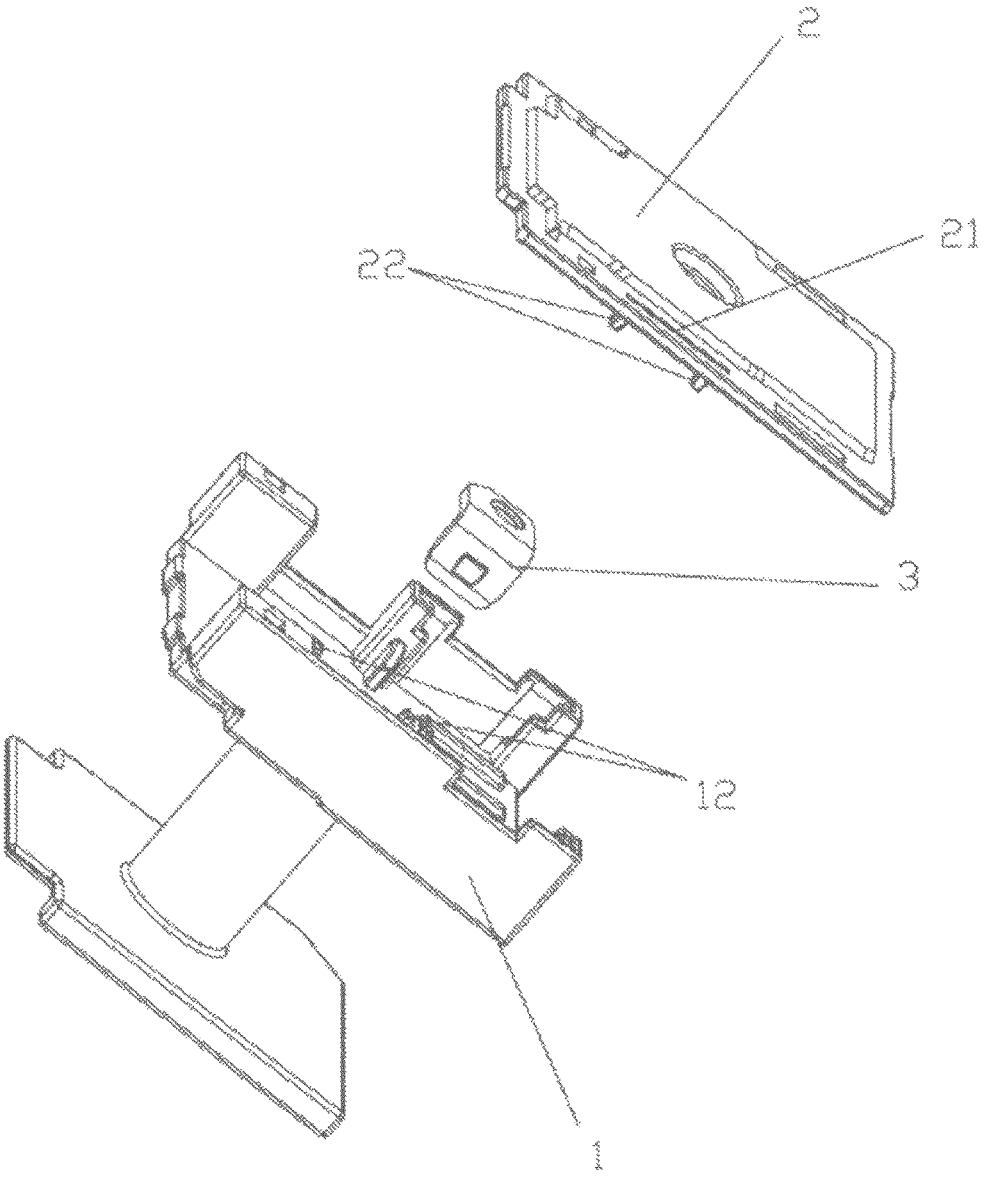
FIG. 5 is a structure exploded schematic view of an embodiment of the present disclosure.
Figure 6:
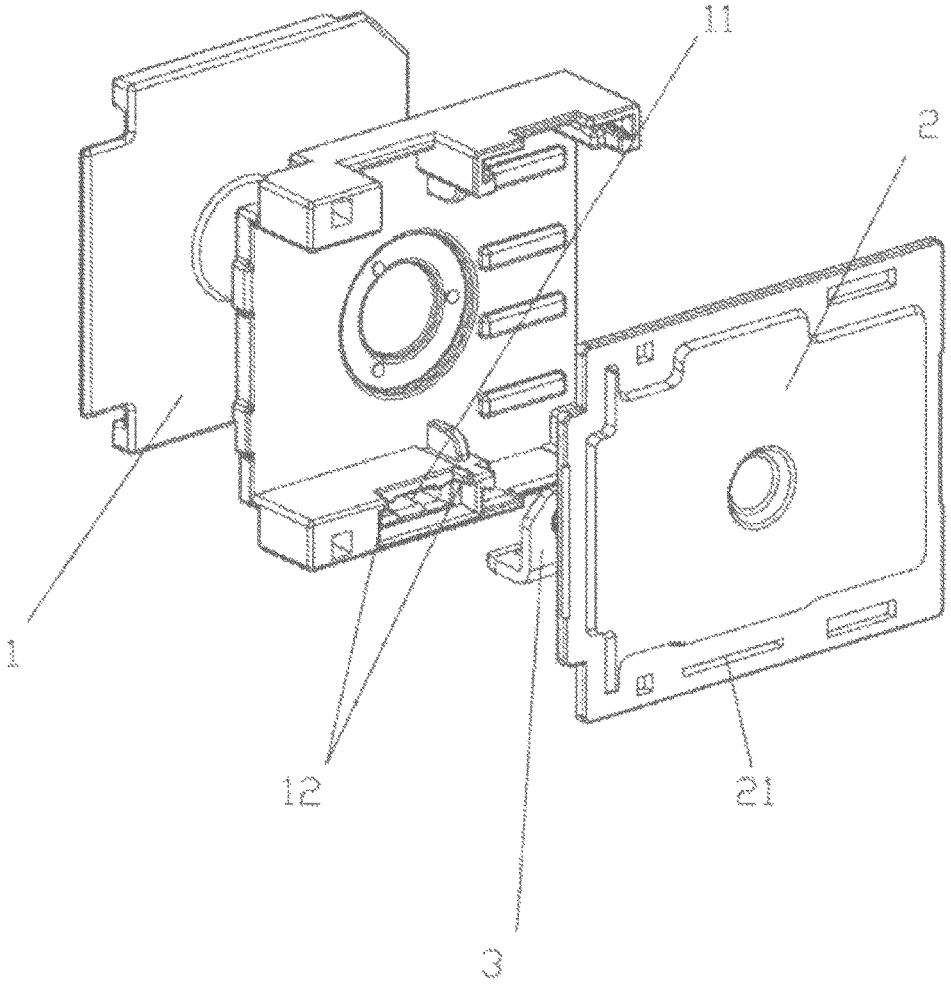
FIG. 6 is a structure exploded schematic view of an embodiment of the present disclosure (rotating an angle)
Figure 7:
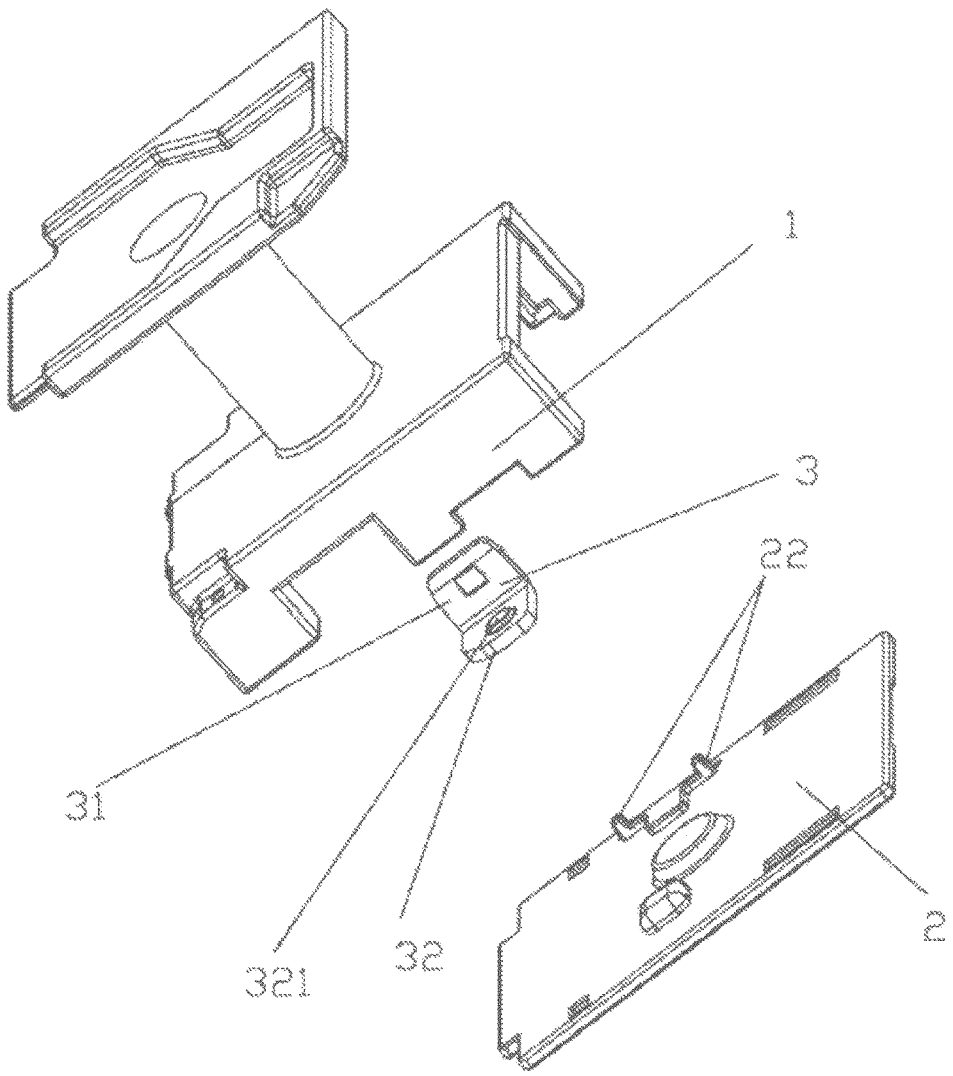
FIG. 7 is a structure exploded schematic view of an embodiment of the present disclosure (rotating an angle again)
Figure 8:
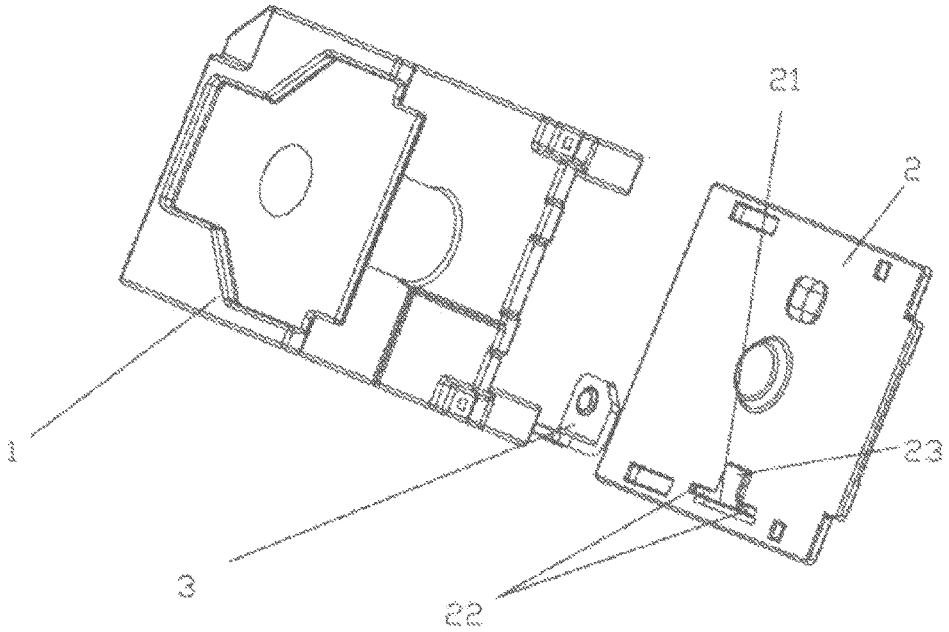
FIG. 8 is a structure exploded schematic view of an embodiment of the present disclosure (rotating an angle yet)
Figure 9:
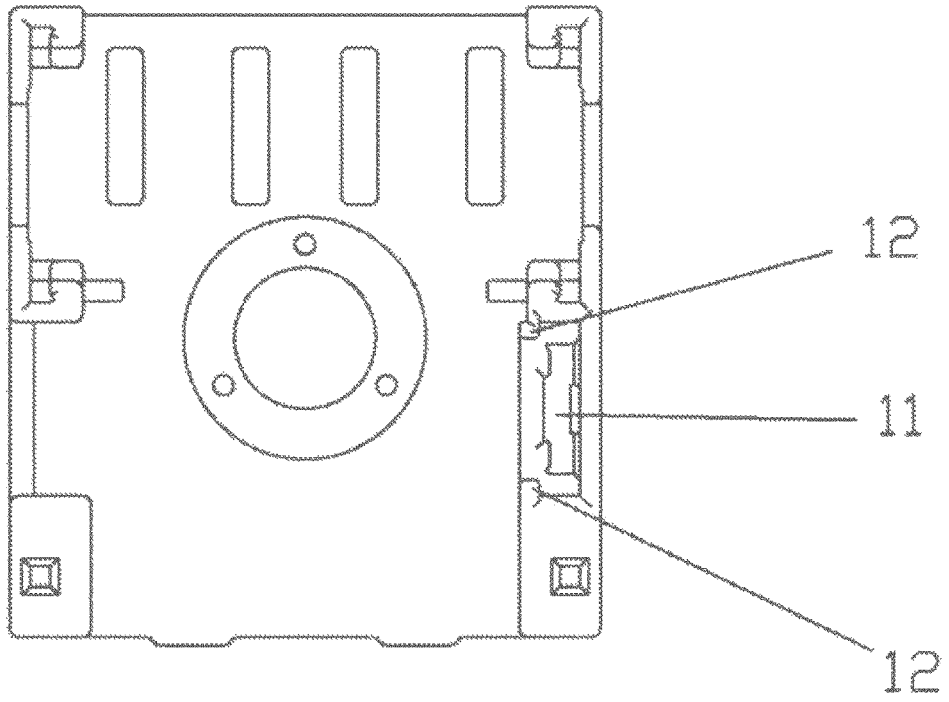
FIG. 9 is a structure schematic view of a bobbin of an embodiment of the present disclosure.
Figure 10:
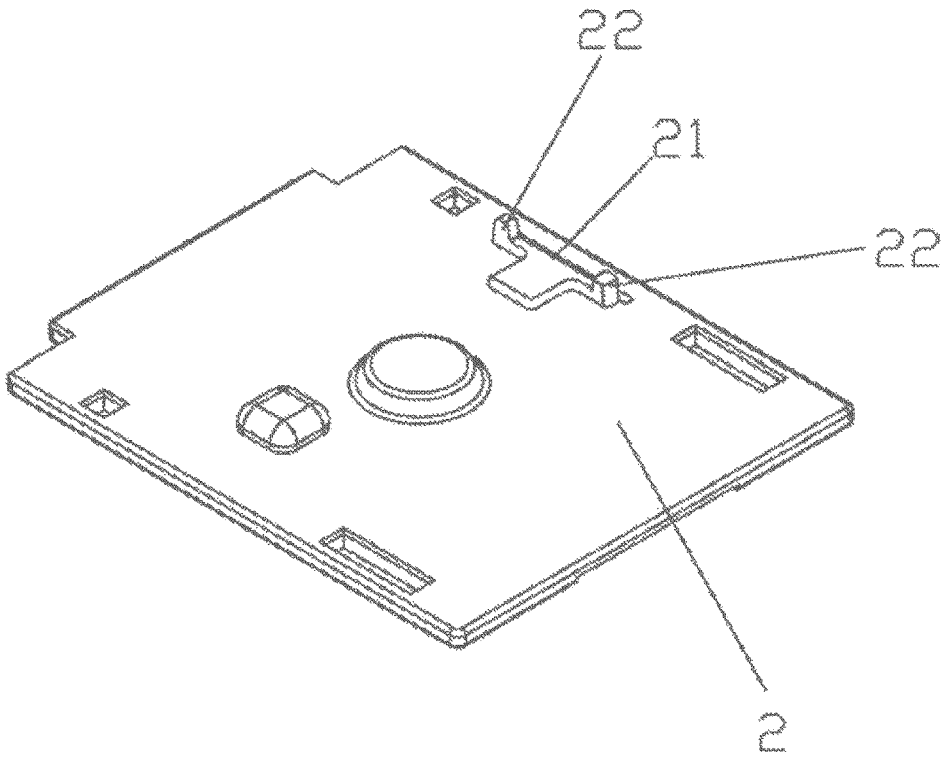
FIG. 10 is a structure schematic view of a bottom plate (a side facing a metal part facing upward) of an embodiment of the present disclosure.
Figure 11:
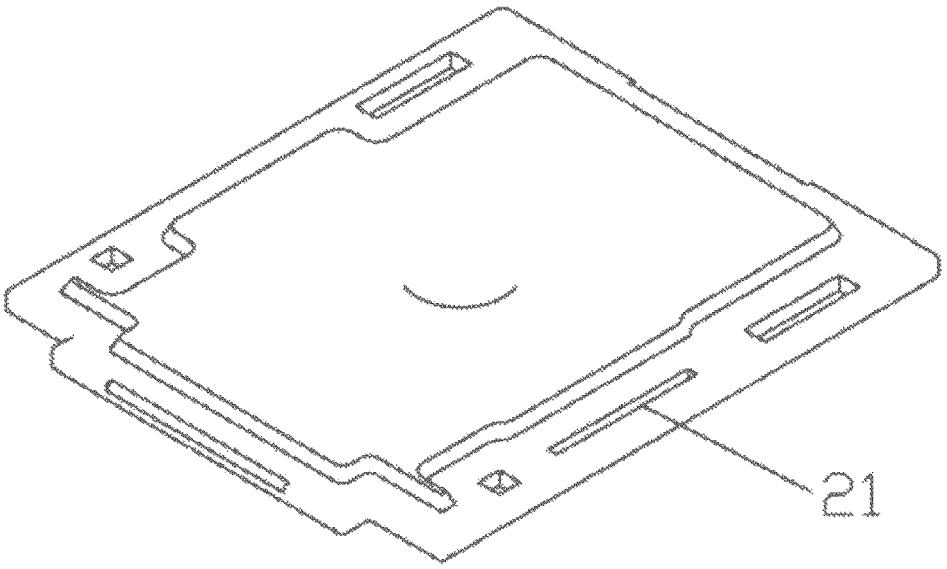
FIG. 11 is a structure schematic view of the bottom plate (a side facing the metal part facing downward) of an embodiment of the present disclosure.
Figure 12:
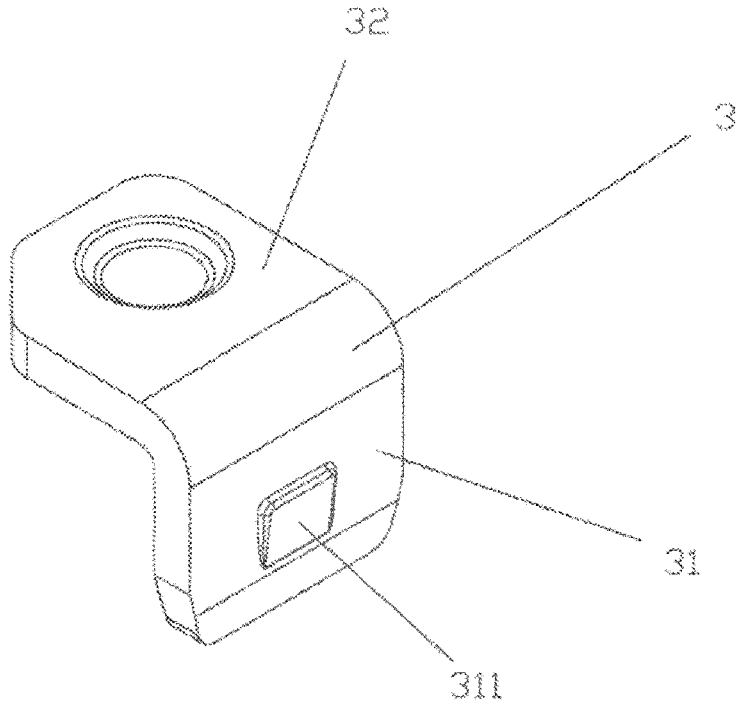
FIG. 12 is a structure schematic view of a positioning component of an embodiment of the present disclosure.
Figure 13:
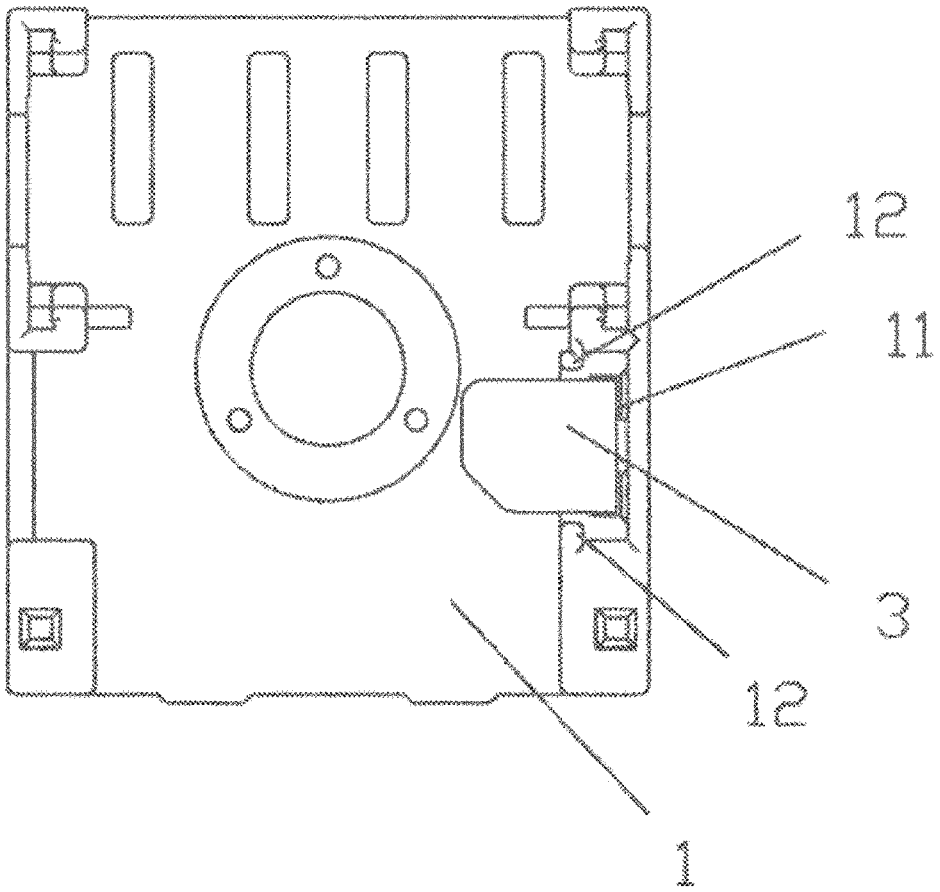
FIG. 13 is an engagement schematic view of a positioning component and a coil frame of an embodiment of the present disclosure.

Referring to FIG. 1 to FIG. 13, a fixing structure between a metal part and a plastic part of a relay/circuit breaker according to an embodiment of the present disclosure includes a metal part 3, a first plastic part 1 and a second plastic part 2. In the present embodiment, the first plastic part 1 is a bobbin, the second plastic part 2 is a bottom plate and the metal part 3 is a positioning component. The positioning component is used to limit the moving distance of a movable spring. The bobbin 1 is provided with a positioning groove 11, and the positioning component 3 is in an L-shape. One portion 31 of the positioning component 3 is inserted and positioned in the positioning groove 11 of the bobbin 1, and the other portion 32 of the positioning component 3 is positioned between the bobbin 1 and the bottom plate 2. A through hole 21 is disposed at a position of the bottom plate 2 near the positioning groove 11, a glue is dispensed to the positioning groove 11 through the through hole 21, thereby packaging the bobbin 1, the positioning component 3 and the bottom plate together. A first glue blocking rib 12 fitting with a corresponding side of the other portion 32 of the positioning component 3 is respectively disposed at a position corresponding to both sides of the positioning groove 11 of the bobbin 1, that is, each of the two sides of the other portion 32 of the positioning component 3 is respectively corresponded to one first glue blocking rib 12, to prevent the glue entering through the through hole from flowing to the inside of the relay/circuit breaker.

In the present embodiment, in one side of the bottom plate 2 facing the positioning component 3, a second glue blocking rim 22 fining with the corresponding side of the other portion 32 of the positioning component 3 is respectively disposed at the position corresponding to the both sides of the positioning groove 11.

The second glue blocking rib 22 is interposed with the first glue blocking rib 12 to simultaneously block in the path in which the glue flowing to the inside of the relay/circuit breaker.

In the present embodiment, the first glue blocking rib 12 and the second glue blocking rib 22 are disposed side by side with respect to the corresponding side of the other portion of the metal part, that is, distributed in a straight line. The first glue blocking rib and the second glue blocking rib are in a completely overlapping state, and are blocked in a path in which the glue flows to the inside of the relay/circuit breaker.

Of course, there may be another structure. The first glue blocking rib 12 and the second glue blocking rib 22 are not completely aligned with respect to the corresponding side of the other portion of the metal part. The first glue blocking rib and the second glue blocking rib are in a partly overlapping state, and are blocked in a path in which the glue flows to the inside of the relay/circuit breaker.

In the present embodiment, a side of the bottom plate 2 facing the positioning component 3 is further provided with a lug boss 23 for positioning the positioning component 3. The lug boss 23 is against the positioning component 3 to position the positioning component 3 in a direction convex with respect to the lug boss 23.

In the present embodiment, the outer side of the one portion 31 of the positioning component 3 is provided with a positioning convex bract 311. When the one portion 31 of the positioning component 3 is inserted into the positioning groove 11 of the bobbin 1, the inner side of the one portion 31 of the positioning component 3 is attached to the groove wall of the positioning groove 11 for positioning through the convex bract 311.

In the present embodiment, the inner side of the other portion 32 of the metal part is provided with a limiting convex bract 321, and the height of the convex bract can be adjusted as needed to adjust the product gap.

The positioning groove 11 disposed in the first plastic part (ie. the bobbin 1) is adopted in the fixing structure between the metal part and the plastic part of the relay/circuit breaker according to an embodiment of the present disclosure. The one portion 31 of the metal part (ie. the positioning component 3) is suitably fitted into the positioning groove 11. The other portion 32 of the positioning component 3 is positioned between the bobbin 1 and the second plastic part (ie. the bottom plate 2). And the through hole 21 is disposed at the position of the bottom plate 2 near the positioning groove 11. The glue is dispensed into the positioning groove 11 through the through hole 21 to fix the bobbin 1, the positioning component 3 and the bottom plate 2 together. In the fixing manner of the positioning component 3 of the embodiment of the present disclosure, the related art method of the manner of the convex bract engaged into a slot. Therefore, no particle is generated during the assembly process of the product, and the internal environment of the product is not contaminated. At the same time, in this fixing manner, the positioning component 3 is not easily released after being fixed, and the dimensional stability is strong. Further, since one first glue blocking rib 12 suitably fitting with the side of the other portion of the positioning component 3 is respectively disposed on the position of the bobbin 1 corresponding to both sides of the positioning groove 11, the first glue blocking rib 12 can be used to prevent the glue entering through the through hole from flowing to the inside of the relay/circuit breaker.

One second glue blocking rim 22 suitably fitting with the side of the other portion 32 of the positioning component 3 is adopted by the fixing structure between the metal part and the plastic part of a relay/circuit breaker according to an embodiment of the present disclosure, the second glue blocking rim 22 is respectively disposed at the position corresponding to the both sides of the positioning groove 11 in one side of the bottom plate 2 facing the positioning component 3. Both the fixing stability of the positioning component 3 can be increased and the glue entering through the through hole can be further prevented from flowing into the inside of the relay/circuit breaker by using the intersection of the first glue blocking rib 12 with the second glue blocking rib 22. One lug boss 23 for positioning the positioning component 3 in the side of the bottom plate 2 facing the positioning component 3 is adopted in the embodiment of the present disclosure, and the lug boss 23 is used to further firmly positioned the positioning component 3.

The above described are only preferred embodiments of the disclosure and are not intended to limit the disclosure in any way. Although the present disclosure has been disclosed above in the preferred embodiments, it is not intended to limit the disclosure. Without departing from the scope of the technical solutions of the present disclosure, any of the possible variations and modifications of the technical solutions of the present disclosure can be made, or modified into equivalent embodiments by those skilled in the art. Therefore, any content that does not deviate from the technical solution of the present disclosure, any simple modifications, equivalent changes and modifications to the above embodiments in accordance with the technology substance of the present disclosure should all fall within the protecting scope of the technical solutions of the present disclosure.

What is claimed is:

1. A fixing structure between a metal part and a plastic part of a relay/circuit breaker, comprising a metal part, a first plastic part and a second plastic part; wherein a positioning groove is disposed on the first plastic part, one portion of the metal part is inserted and positioned in the positioning groove of the first plastic part, and other portion of the metal part is positioned between the first plastic part and the second plastic part; a through hole is disposed at a position of the second plastic part near the positioning groove, a glue is dispensed into the positioning groove through the through hole to package the first plastic part, the metal part and the second plastic part together; a first glue blocking rib suitably fitting with a corresponding side of the other portion of the metal part is respectively disposed at a position of the first plastic part corresponding to both sides of the positioning groove to prevent the glue entering through the through hole from flowing to an inside of the relay/circuit breaker.

2. The fixing structure between the metal part and the plastic part of the relay/circuit breaker according to claim 1 wherein a cross section of the metal part is in an L-shape.

3. The fixing structure between the metal part and the plastic part of the relay/circuit breaker according to claim 2, wherein a second glue blocking rib suitably fitting with the corresponding side of the other portion of the metal part is respectively disposed at a position corresponding to both sides of the positioning groove in one side of the second plastic part facing the metal part.

4. The fixing structure between the metal part and the plastic part of the relay/circuit breaker according to claim 3, wherein the second glue blocking rib is interposed with the first glue blocking rib to simultaneously block in a path in which the glue flows to the inside of the relay/circuit breaker.

5. The fixing structure between the metal part and the plastic part of the relay/circuit breaker according to claim 4, wherein the first glue blocking rib and the second glue blocking rib are disposed side by side with respect to the corresponding side of the other portion of the metal part to completely overlap and block in the path in which the glue flows to the inside of the relay/circuit breaker.

6. The fixing structure between the metal part and the plastic part of the relay/circuit breaker according to claim 4, wherein the first glue blocking rib and the second glue blocking rib are not completely aligned with respect to the corresponding side of the other portion of the metal part, and wherein the first glue blocking rib and the second glue blocking rib are configured to partly overlap and block in the path in which the glue flows to the inside of the relay/circuit breaker.

7. The fixing structure between the metal part and the plastic part of the relay/circuit breaker according to claim 1, wherein one side of the second plastic part facing the metal part is further provided with a lug boss for positioning the metal part, the lug boss is against the metal part to position the metal part in a direction convex with respect to the lug boss.

8. The fixing structure between the metal part and the plastic part of the relay/circuit breaker according to claim 1, wherein an outer side of the one portion of the metal part is provided with a positioning convex bract, when the one portion of the metal part is inserted into the positioning groove of the first plastic part, an inner side of the one portion of the metal part is attached to a groove wall of the positioning groove for positioning through the convex bract.

9. The fixing structure between the metal part and the plastic part of the relay/circuit breaker according to claim 8, wherein an inner side of the other portion of the metal part is provided with a limiting convex bract.

10. The fixing structure between the metal part and the plastic part of the relay/circuit breaker according to claim 1, wherein a second glue blocking rim suitably fitting with the corresponding side of the other portion of the metal part is respectively disposed at a position corresponding to both sides of the positioning groove in one side of the second plastic part facing the metal part.

* * * * *